US005900076A

United States Patent [19]

Hayashi et al.

[11] Patent Number: 5,900,076

[45] Date of Patent: May 4, 1999

[54] BAINITIC STEEL MATERIALS HAVING A LESS SCATTERING OF PROPERTIES AND METHOD OF PRODUCING THE SAME

[75] Inventors: Tohru Hayashi; Keniti Amano; Mitsuhiro Okatsu; Kenji Oi; Fumimaru Kawabata; Tomoya Koseki; Noritsugu Itakura; Hiroki Ota, all of Kurashiki, Japan

[73] Assignee: Kawasaki Steel Corporation, Kobe, Japan

[21] Appl. No.: 08/979,625

[22] Filed: Nov. 28, 1997

Related U.S. Application Data

[62] Division of application No. 08/646,373, filed as application No. PCT/JP95/01871, Sep. 20, 1995, Pat. No. 5,766,381.

[30] Foreign Application Priority Data

Sep. 20, 1994 [JP] Japan ..... 6-224922

[51] Int. Cl.[6] ..... C22C 38/12; C21D 8/00

[52] U.S. Cl. ..... 148/330; 148/320; 148/624; 148/654

[58] Field of Search ..... 148/624, 654, 148/328, 330, 320; 420/127, 121

[56] References Cited

U.S. PATENT DOCUMENTS 4,210,445 7/1980 Kasamatsu et al. .

FOREIGN PATENT DOCUMENTS

| | | |
|---|---|---|
| 80-809 | 6/1983 | European Pat. Off. . |
| A-54-132421 | 10/1979 | Japan . |
| A-54-134019 | 10/1979 | Japan . |
| A-55-100924 | 8/1980 | Japan . |
| A-57-63628 | 4/1982 | Japan . |
| A-60-245722 | 12/1985 | Japan . |
| A-62-130215 | 6/1987 | Japan . |
| A-63-286517 | 11/1988 | Japan . |
| A-64-55334 | 3/1989 | Japan . |
| A-4-224623 | 8/1992 | Japan . |
| A-5-331538 | 12/1993 | Japan . |
| A-6-93332 | 4/1994 | Japan . |
| 2116999 | 10/1983 | United Kingdom . |

OTHER PUBLICATIONS

"Tetsu–to–Hagane", vol. 74, No. 6, "On the Yield Ratio of the Structural Steel Used for Building Frames", pp. 11–21, Ben KATO Jul. 7, 1998.

*Primary Examiner*—Deborah Yee
*Attorney, Agent, or Firm*—Oliff & Berridge, PLC

[57] ABSTRACT

This invention provides bainite steel materials having a less scattering of properties in a thickness direction or between steel materials by using a chemical composition of C: not less than 0.001 wt % but less than 0.030 wt %, Si: not more than 0.60 wt %, Mn: 1.00–3.00 wt %, Nb: 0.005–0.20 wt %, B: 0.0003–0.0050 wt % and Al: not more than 0.100 wt % and rendering not less than 90% of the material into a bainite texture in steel materials such as thick steel plates, steel sheets, section steels, rod steels and the like.

12 Claims, 4 Drawing Sheets

BAINITIC STEEL MATERIALS HAVING A LESS SCATTERING OF PROPERTIES AND METHOD OF PRODUCING THE SAME

This is a division of application Ser. No. 08/646,373 filed May, 15, 1996, now U.S. Pat. No. 5,766,381 which is the U.S. National Stage Application of International Application PCT/JP95/1871, filed Sep. 20, 1995.

TECHNICAL FIELD

This invention relates to steel materials having a thickness of not less than 30 mm such as plates, sheets, sections, rods and the like for use in fields of buildings, marine structures, pipes, shipbuildings, storing tanks, public works, construction machines and the like, and more particularly to steel materials having a less scattering of properties and a method of producing the same.

BACKGROUND ART

As mentioned above, thick steel materials represented by thick plates are used in various fields for improving properties such as high strength, high toughness and the like. Recently, it is demanded that these properties are uniform in the thickness direction of the steel material and the scattering of these properties between the steel materials is less.

For example, it is reported in pages 11 to 21 of "Tetsu-to-Hagane", Vol. 74(1988), No. 6 that the destruction of high-rise buildings is designed to be controlled by absorbing vibration energy through the deformation of the building against big earthquake with the heightening of the building. Concretely, the framework of the building is fallen down at a given form in the occurrence of earthquake and hence the deconstruction of the building is controlled by the plasticization of the framework. That is, assuming that the framework of the building indicates a behavior aimed by the designer in the occurrence of earthquake, it is required that the proof ratio of the steel material used in pillar, beam and the like of the building is completely grasped by the designer. Therefore, it is inevitable that the steel materials such as plates, H-sections and the like for use in the pillar, beam and the like are homogeneous, and also the scattering of strength in the steel material becomes a great problem.

Since the steel materials used in the buildings and shipbuildings are required to have high tension and toughness, these materials are usually produced by controlled rolling and controlled cooling process or so-called TMCP process. However, if thick steel materials are produced by the TMCP process, the cooling rate differs in the thickness direction or between the steel materials to change the texture, and hence the scattering of properties is caused in the thickness direction of the resulting steel material or between the steel materials. The scattering of properties appears in the thickness direction of the thick steel plate, between web and flange of H-section steel because of non-uniform cooling between the web and the flange, between the lots of the steel material or the like.

In JP-A-4-224623, it is proposed that the texture in the thickness direction can be changed into a mixed texture of ferrite and bainite by adding Nb and making the cooling rate after the rolling not less than 3° C./s and setting an upper limit of the cooling stop temperature at 500° C., whereby the strength of a center portion in the thickness direction is increased to decrease the difference of hardness in the thickness direction. In this case, however, the cooling rate should strictly be controlled to not less than 3° C./s even in the center portion, because if a cooling rate distribution is formed in the thickness direction, a scattering of properties is immediately caused. As a result, it is required to strictly control production, so that the above proposal is unsuitable for the production in industrial scale.

In JP-A-62-130215, it is proposed to improve low-temperature toughness by ensuring strength through precipitation strengthening of Cu and by cooling to 300–700° C. at a cooling rate of not less than 0.5° C./s after the hot rolling and holding at a temperature zone of 500–650° C. for a constant time and then cooling to room temperature. However, this technique aims at the improvement of low-temperature toughness, so that it is difficult to satisfy the uniformity of the properties required in recent structural steels or the like by controlling the scattering of properties at various forms as mentioned above.

DISCLOSURE OF INVENTION

It is, therefore, an object of the invention to provide steel materials solving the above problems or having a less scattering of properties in the thickness direction or between the steel materials without restriction in the production step as well as a method of producing these steel materials.

Now, the scattering of properties in the thick steel materials, typically thick steel plate results from the fact that the variation of texture is caused by a large change of cooling rate in thickness direction ranging from a surface of a steel material to a center portion thereof or by a change of cooling rate based on the scattering of production conditions. In order to avoid the variation of texture, it is important to provide a homogeneous texture over a wide range of the cooling rate.

Therefore, the inventors have made studies by going back to the starting point with respect to a technique of obtaining a homogeneous texture even if the production conditions are changed and found that steel materials having a less scattering of properties and a constant texture in the thickness direction irrespectively of the change of cooling rate are obtained by newly designing a chemical composition of the steel material.

That is, the chemical composition completely eliminating the change of strength due to the change of carbide precipitation form based on the change of cooling rate is realized by adding proper amounts of Mn, Nb lowering $Ar_3$ point for rendering the texture into a single phase of bainite without depending upon the cooling rate, adding B lowering grain boundary energy of old austenite grain boundary for precipitating no ferrite even at a low cooling rate and further restricting C content to control the precipitation of carbide in bainite. According to this chemical composition, the texture is rendered into the single phase of bainite through usual production steps without depending upon the rolling conditions and cooling conditions, whereby the scattering of strength and toughness is suppressed to a minimum level.

The invention is as follows:

(1) A bainite steel material having a less scattering of properties, characterized in that the steel material has a chemical composition comprising C: not less than 0.001 wt % but less than 0.030 wt %, Si: not more than 0.60 wt %, Mn: 1.00–3.00 wt %, Nb: 0.005–0.20 wt %, B: 0.0003–0.0050 wt % and Al: not more than 0.100 wt % and not less than 90% thereof is a bainite texture (first invention), (2) A bainite steel material having a less scattering of properties, wherein the steel material in the first invention further contains Cu: 0.7–2.0 wt % (second invention), (3) A bainite steel material having a less scattering of properties, wherein the steel material in the first invention or second invention further contains Ti: 0.005–0.20 wt % (third invention), (4) A bainite steel material having a less scattering of properties, wherein the steel material in the first invention, second invention or third invention further contains V: 0.005–0.20 wt % (fourth invention), (5) A bainite steel material having a less scattering of properties, wherein the steel material in the first invention, second invention, third invention or fourth invention further contains one or more of Ni: not more than 2.0 wt %, Cr: not more than 0.5 wt %, Mo: not more than 0.5 wt %, W: not more than 0.5 wt % and Zr: not more than 0.5 wt % (fifth invention), (6) A bainite steel material having a less scattering of properties, wherein the steel material in the first invention, second invention, third invention, fourth invention or fifth invention further contains not more than 0.02 wt % of at least one of REM and Ca (sixth invention).

Furthermore, the above thick steel materials can be produced by using a starting steel material having various compositions according to the chemical composition defined in each of the first to sixth inventions through the following three methods. That is, they are as follows.

(A) A production method wherein the starting steel material is heated to a temperature of $AC_3$–1350° C. in the hot rolling of the starting steel material, and the rolling is terminated at an austenite unrecrystallization temperature region of not lower than 800° C. and then the cooling is conducted.

(B) A production method wherein the starting steel material is heated to a temperature of $AC_3$–1350° C. in the hot rolling of the starting steel material, and the rolling is terminated at an austenite unrecrystallization temperature region of not lower than 800° C. and then the cooling is conducted and thereafter a precipitation treatment is carried out by reheating to and holding at a temperature region of not lower than 500° C. but lower than 800° C.

(C) A production method wherein the starting steel material is heated to a temperature of $AC_3$–1350° C. in the hot rolling of the starting steel material, and the rolling is terminated at an austenite unrecrystallization temperature region of not lower than 800° C. and then a precipitation treatment is carried out by acceleration cooling at a cooling rate of 0.1–80° C./s to-a given temperature of not lower than 500° C but lower than 800° C. which is a precipitation treating temperature region and isothermally holding at the temperature region of not lower than 500° C. but lower than 800° C. or cooling at a cooling rate of not more than 1° C./s in this temperature region for not less than 30 seconds and thereafter the cooling is conducted.

BEST MODE FOR CARRYING OUT THE INVENTION

The reason on the limitation of the chemical composition in the steel materials according to the invention will be described below.

C: not less than 0.001 wt % but less than 0.030 wt %

C is necessary to be not less than 0.001 wt % in order to provide a single phase of bainite irrespectively of the cooling rate. On the other hand, when it is not less than 0.030 wt %, carbide precipitates in an inner portion of bainite texture or a lath boundary and the precipitation form of carbide changes as the cooling rate varies, so that it is difficult to obtain a constant strength over a wide range of the cooling rate.

Figure 1:
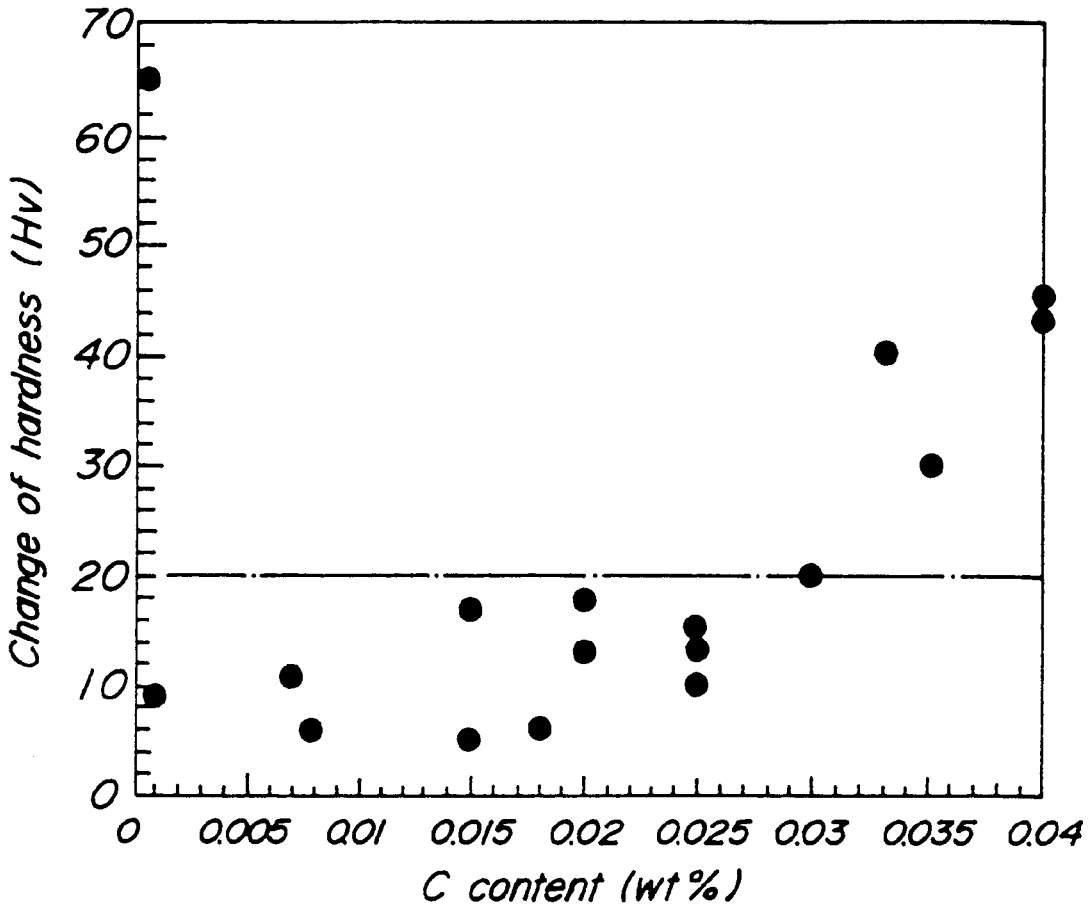
FIG. 1 is a graph showing a relation between C content and scattering of strength in a thick steel plate.

In this connection, the difference of hardness between maximum value and minimum value in the thickness direction (change of hardness) is investigated with respect to thick steel plates having a thickness of 80 mm when C content is varied in the chemical composition according to the invention. Moreover, the chemical composition other than C comprises Si: 0.02 wt %, Mn: 1.6 wt %, Nb: 0.020 wt %, B: 0.0018 wt % and Al: 0.03 wt %. As seen from the results shown in FIG. 1, when C content is not less than 0.001 wt % and not less than 0.030 wt %, the change of hardness exceeds Hv: 20 and the scattering of strength becomes conspicuous. Therefore, the C content is limited to not less than 0.001 wt % but less than 0.030 wt %.

Moreover, when the upper limit of C is preferably 0.02 wt %, the excellent resistance to stress corrosion cracking through sulfide can be provided in addition to the homogeneous texture. That is, the inclusion of hydrogen sulfide in crude oil or natural gas is frequent in pipeline of transferring petroleum or natural gas, a tank for storing LPG and the like. In this case, the surface of the steel plate is corroded in an atmosphere of hydrogen sulfide and atomic hydrogen penetrated from the corroded surface into steel locally enriches in steel, so that the susceptibility to cracking becomes higher. At the same time, stress corrosion cracking is created at the enriched region of atomic hydrogen by stress produced in a circumferential direction of a pipeline during the transportation of crude oil or natural gas to bring about the breakage of the steel material. Therefore, it is important to prevent the peculiar stress corrosion cracking under a sulfide environment or so-called stress corrosion cracking through sulfide. When the C content is restricted to not more than 0.02 wt %, transformation strain due to shearing transformation is solved to prevent the enrichment of atomic hydrogen penetrated into steel under sulfide corroding environment, while the rise of strength is attained by precipitation strengthening of Cu, whereby a very excellent resistance to stress corrosion cracking through sulfide can be obtained even under an environment of a high hydrogen sulfide concentration while providing the strength and low-temperature toughness equal to or more than those of the conventional steel material.

Si: not more than 0.60 wt %

When Si amount exceeds 0.60 wt %, the toughness at weld portion is degraded, so that it is restricted to not more than 0.60 wt %. Moreover, the amount added is preferable to be not less than 0.02 wt % in order to conduct deoxidation and ensure the strength.

Mn: 1.00–3.00 wt %

The amount of Mn is required to be not less than 1.0 wt %, preferably not less than 1.50 wt % in order to provide a single phase of bainite, particularly make the volume ratio on bainite texture to not less than 90%. However, when it exceeds 3.00 wt %, the hardening through welding becomes considerably higher and the toughness at a heat affected zone (HAZ) is degraded. Therefore, it is restricted to a range of 1.50–3.00 wt %.

Nb: 0.005–0.20 wt %

Nb has an effect of lowering $Ar_3$ to widen the range of forming bainite toward a side of low cooling rate and is required to stably provide the bainite texture. Furthermore, it contributes to the precipitation strengthening and is effective to improve the toughness. In order to expect these effects, it is necessary to be not less than 0.005 wt %. On the other hand, when it exceeds 0.20 wt %, the effect of improving the toughness is saturated and it becomes disadvantage from economical reasons. Therefore, the upper limit is 0.20 wt %.

B: 0.0003–0.0050 wt %

B is required to be not less than 0.0003 wt % in order to provide the single phase of bainite< while when it exceeds 0.0050 wt %, BN is precipitated to degrade the weldability, so that it is restricted to a range of 0.0003–0.0050 wt %.

Al: not more than 0.100 wt %

When the amount of Al exceeds 0.100 wt %, the weldability is damaged, so that it is restricted to not more than 0.100 wt %. Moreover, it is favorable to add in an amount of not less than 0.010 wt % for the deoxidation.

The invention lies in that the homogeneous texture, concretely texture containing not less than 90% of bainite is obtained by adjusting the basic chemical composition to the above component ranges without hardly depending upon the production conditions, particularly cooling rate. This is clear from experimental results shown in FIG. 2.

Figure 2:
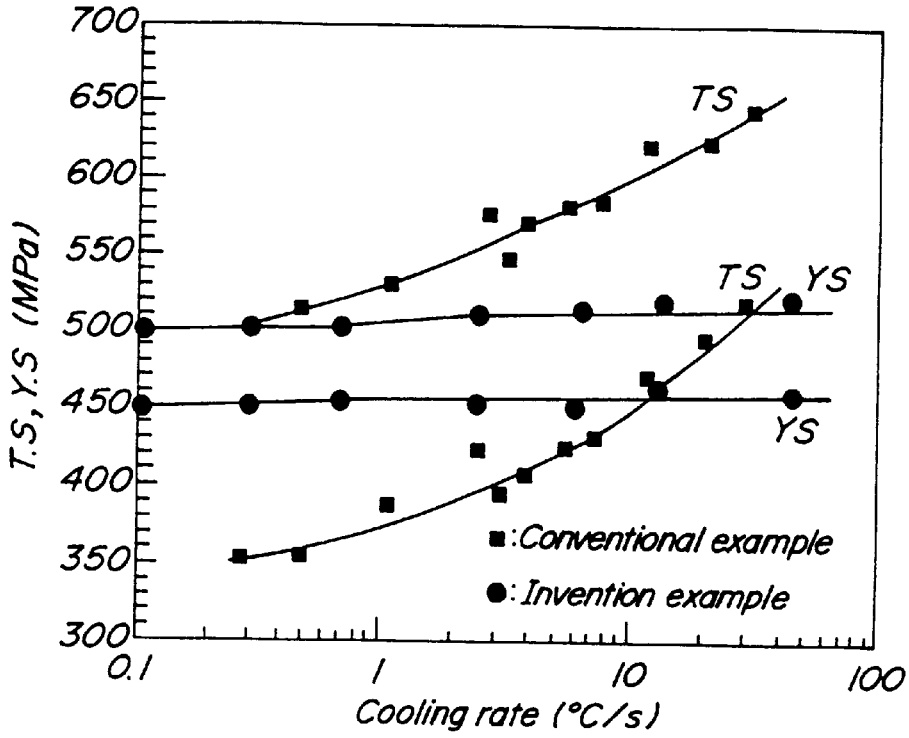
FIG. 2 is a graph showing a relation between cooling rate and strength in a thick steel plate.

That is, FIG. 2 shows measurement results of tensile strength on steel sheets obtained by varying the cooling rate within a range of 0.1–50° C./s in the production step of the component-adjusted steel according to the invention (invention example) and the conventional steel used as a building material (conventional example). As seen from this figure, a constant strength is obtained by the component adjustment according to the invention without depending upon the cooling rate. Particularly, the scattering value of Y.S and T.S becomes less over a wide range of the cooling rate which has never been anticipated in the conventional technique. This is based on the contribution of restriction of C content and proper addition of Mn and Nb and further a as mentioned above. Therefore, the strength does not change in accordance with the cooling rate even if the cooling rate is changed in the thickness direction of the thick steel plate, and hence the thick steel plate having a less scattering of properties in the thickness direction is obtained.

In this case, the invention example has a chemical composition comprising C: 0.007 wt %, Si: 0.02 wt %, Mn: 1.55 wt %, Nb: 0.024 wt %, B: 0.0018 wt % and Al: 0.032 wt % and the remainder being iron and inevitable impurities, while the conventional example has a chemical composition comprising C: 0.14 wt %, Si: 0.4 wt %, Mn: 1.31 wt %, Al: 0.024 wt %, Nb: 0.015 wt % and Ti: 0.013 wt %. Moreover, many thick steel plates having a thickness of 15 mm were produced by varying the cooling rate at the same production step and then the tensile strength was measured with respect to test specimens taken out from these thick steel plates.

In the invention, the levels of strength and toughness can freely be controlled by adding given components to the above basic chemical composition. In this case, the previously formed homogeneous texture is hardly influenced by the addition of new components, so that thick steel plates having a less scattering of properties and high strength and/or high toughness are easily obtained.

In order to improve the strength, Cu: 0.7–2.0 wt % and further Ti: 0.005–0.20 wt % and/or V: 0.005–0.20 wt % can be added as a precipitation strengthening component. Moreover, in case of adding these precipitation strengthening components, the strengthening may be more attained by subjecting to a precipitation strengthening treatment as mentioned below.

Cu: 0.7–2.0 wt %

Cu is added for attaining the precipitation strengthening and solid-solution strengthening. When the amount exceeds 2.0 wt %, the toughness is rapidly degraded, while when it is less than 0.7 wt %, the precipitation strengthening effect is less, so that it is restricted to a range of 0.7–2.0 wt %.

Ti: 0.005–0.20 wt %

Ti is required to be not less than 0.005 wt% for lowering $Ar_3$ to contribute to the formation of bainite texture and forming TiN to improve the toughness of weld portion and attaining the precipitation strengthening, while when it exceeds 0.20 wt %, the toughness is degraded, so that it is restricted to a range of 0.005–0.20 wt %.

V: 0.005–0.20 wt %

V is added in an amount of not less than 0.005 wt % for the precipitation strengthening. While, when it exceeds 0.20 wt %, the effect is saturated, so that the upper limit is 0.20 wt %.

Further, one or more of Ni: not more than 2.0 wt %, Cr: not more than 0.5 wt %, Mo: not more than 0.5 wt %, W: not more than 0.5 wt % and Zr: not more than 0.5 wt % can be added in order to more improve the strength. Moreover, these components develop the effect even at slight amounts, so that the lower limit thereof properly be set.

Ni: not more than 2.0 wt %

Ni improves the strength and toughness and is effective to prevent Cu cracking in the rolling if Cu is added. However, it is expensive and the effect is saturated at an excessive addition. Therefore, it is added in an amount of not more than 2.0 wt %. Moreover, when it is less than 0.05 wt %, the effect is insufficient, so that the addition amount is favorable to be not less than 0.05 wt %.

Cr: not more than 0.5 wt %

Cr gas an effect of raising the strength, but when the addition amount exceeds 0.5 wt %, the toughness of weld portion is degraded, so that the amount is restricted to not more than 0.5 wt %. Moreover, the lower limit is favorable to be 0.05 wt %.

Mo: not more than 0.5 wt %

Mo has an effect of raising the strength at room temperature and higher temperatures, but when it exceeds 0.5 wt %, the weldability is degraded, so that the addition amount is restricted to not more than 0.5 wt %. Moreover, the lower limit is favorable to be 0.05 wt % because when it is less than 0.05 wt %, the effect of raising the strength is insufficient.

W: not more than 0.5 wt %

W has an effect of raising the strength at higher temperatures, but is expensive. When it exceeds 0.5 wt %, the toughness is degraded, so that the addition amount is restricted to not more than 0.5 wt %. Moreover, the addition amount is favorable to be not less than 0.05 wt % because when it is less than 0.05 wt %, the effect of raising the strength is insufficient.

Zr: not more than 0.5 wt %

Zr has not only the effect of raising the strength but also an effect of improving the resistance to plated cracking when the steel material is subjected to, for example, zinc plating. When it is added so as to exceed 0.5 wt %, the toughness of weld portion is degraded, so that it is restricted to not more than 0.5 wt %. Moreover, the lower limit is favorable to be 0.05 wt %.

And also, not more than 0.02 wt % of at least one of REM and Ca may be added for improving the toughness of HAZ.

REM forms oxysalfide to suppress the growth of austenite grains and improve the toughness of HAZ. When it is added so as to exceed 0.02 wt %, the cleanness of steel is damaged, so that it is restricted to not more than 0.02 wt %. Moreover, when the addition amount is less than 0.001 wt %, the effect of improving the toughness of HAZ is insufficient, so that it is favorable to be not less than 0.001 wt %.

Ca is effective to improve not only the toughness of HAZ but also the properties in the thickness direction through form control of sulfide in steel. However, when it is added so as to exceed 0.02 wt %, the amount of non-metallic inclusion is increased to create internal defect, so that it is restricted to not more than 0.02 wt %. Moreover, the addition amount is favorable to be not less than 0.0005 wt% because when it is less than 0.0005 wt %, the above effects are insufficient.

In the steel plates according to the invention, the homogeneous texture is obtained by adjusting to the basic chemical composition as mentioned above, so that it is not necessary to strictly control the production conditions. Therefore, they may be produced according to usual manners used in the production of this type of the steel plate.

For instance, it is recommended that a slab of steel having the above adjusted basic chemical composition is heated at a temperature of $Ac_3$–1350° C., and finish-rolled at a temperature of not lower than 800° C. and thereafter cooled.

That is, when the heating temperature is lower than $Ac_3$, austenite can not completely be formed and the homogenization is insufficient, while when it exceeds 1350° C., the surface oxidation becomes violent, so that it is favorable to conduct the heating in a temperature region of $Ac_3$–1350° C. When the finish rolling temperature is lower than 800° C., the rolling efficiency lowers, so that it is preferable to be not lower than 800° C.

Then, the cooling after the rolling is not strictly controlled as usual, so that it is possible to conduct either air cooling and acceleration cooling. The cooling is preferable to be carried out within a range of 0.5–80° C./s. When the cooling is carried out at a cooling rate exceeding 80° C./s, bainite-lath space becomes dense and the strength rises in dependence on the cooling rate, while when it is less than 0.5° C./s, ferrite is formed and it is difficult to provide the single phase of bainite.

Even in the production method, the levels of the strength and toughness can freely be controlled by adding various treating steps likewise the case of adding components as mentioned above.

At first, in the rolling step after the heating to a temperature of $Ac_3$–1350° C., the improvement of the toughness is attempted by rolling in an unrecrystallization temperature region of austenite above 800° C.

Figure 3:
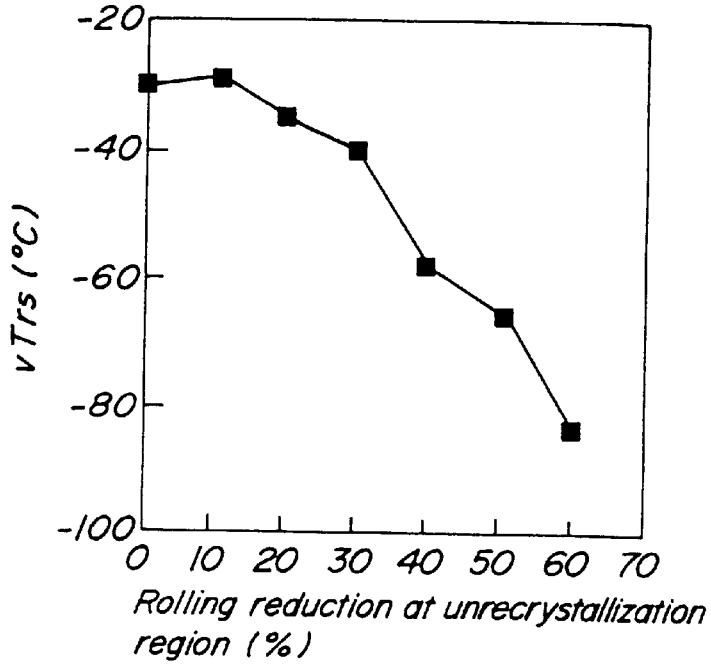
FIG. 3 is a graph showing a relation between rolling reduction at an unrecrystallization region and fracture appearance transition temperature in the resulting steel plate.

That is, the rolling at the unrecrystallization region of austenite has an effect of finely dividing bainite texture through the introduction of work dislocation to improve the toughness. In this connection, the results investigated on a relation between rolling reduction and fracture appearance transition temperature in the unrecrystallization region are shown in FIG. 3, from which the reduction of not less than 30% is recommended because the effect of improving the toughness at a rolling reduction of not less than 30% becomes conspicuous. Moreover, the finish temperature in the experiment shown in FIG. 3 is 900° C. while the chemical composition of the steel plate used in the experiment comprises C: 0.007 wt %, Si: 0.02 wt %, Mn: 1.55 wt %, Al: 0.32 wt %, Nb: 0.024 wt % and B: 0.0018 wt % and the remainder being iron and inevitable impurities. On the other hand, the upper limit of the rolling reduction in the unrecrystallization region is not defined, but the reduction of not less than 95% may be disadvantageous in the operation from a viewpoint of rolling load.

When Cu; 0.7–2.0 wt % and further Ti. 0.005–0.20 wt % and/or V: 0.005–0.20 wt % are added as a precipitation strengthening component, the acceleration cooling is carried out up to a precipitation treating temperature region of not lower than 500° C. but lower than 800° C. at a cooling rate of 0.1–80° C./s after the rolling and then the precipitation treatment is carried out by isothermally holding at the setting temperature for not less than 30 seconds or cooling at a cooling rate of not more than 1° C./s in the temperature region for not less than 30 seconds, which is effective to improve the strength.

That is, when the rate cooling from the completion of the rolling to the precipitation treating temperature is less than 0.1° C./s, ferrite is formed in the bainite texture, while when it exceeds 80° C./s, the bainite-lath space becomes dense and the strength rises in dependence on the cooling rate and the bainite single phase is not formed due to the formation of ferrite at less than 0.1° C./s, so that the cooling rate is within a range of 0.1–80° C./s.

After the acceleration cooling, the precipitation treatment is conducted by the isothermal holding within a temperature region of not lower than 500° C. but lower than 800° C. for not less than 30 seconds or the cooling in this temperature region at a cooling rate of not more than 1° C./s for not less than 30 seconds, whereby one or more of Cu, Ti(CN) and V(CN) and further Nb(CN) are precipitated to attempt the rise of strength. Furthermore, the homogenization of the texture is made by this precipitation treatment and the scattering of properties in the thickness direction is mitigated.

When the temperature of the precipitation treatment is not lower than 800° C., the precipitation hardly occurs because the precipitating components are maintained at a dissolved state, so that it is necessary to conduct the precipitation treatment at a temperature of lower than 800° C. for attaining sufficient precipitation. On the other hand, when it is lower than 500° C., the precipitation reaction hardly occurs, so that the temperature region is restricted to a range of not lower than 500° C. but lower than 800° C. Further, the reason why the holding time is not less than 30 seconds is due to the fact that when it is less than 30 seconds, the sufficient precipitation strengthening can not be attained. On the other hand, the precipitation strengthening is attained even when the cooling is carried out in this temperature region at a cooling rate of not more than 1° C./s for not less than 30 seconds, but when the cooling rate exceeds 1° C./s, the sufficient precipitation strengthening is not obtained. Moreover, the cooling rate of not more than 1° C./s is desirable for attaining the sufficient precipitation strengthening.

The above precipitation treatment may be conducted after the cooling followed to the rolling. That is, the steel plate may be reheated to a temperature region of not lower than 500° C. but lower than 800° C. and held at this temperature region after the cooling.

When the C content in the steel slab is restricted to not more than 0.02 wt % for obtaining the excellent resistance to stress corrosion cracking through sulfide as mentioned above, the holding time or cooling time at the temperature region of not lower than 500° C. but lower than 800° C. is particularly favorable to be not less than 300 seconds. The precipitation treatment simultaneously solves surface defect of bainite grain succeeding rolling strain at not higher than 950° C. and surface defect produced in the shearing transformation, so that the enrichment of atomic hydrogen penetrated into steel under a corrosion environment through sulfide is prevented and the resistance to stress corrosion cracking through sulfide is improved.

EXAMPLE 1

A slab of steel having an adjusted chemical composition as shown in Table 1 is heated to 1150° C., rolled at a finish rolling temperature of 800° C. so as to have a total rolling reduction of 74% and thereafter subjected to an acceleration cooling (cooling rate: 7° C./s) to produce a thick steel plate having a thickness of 80 mm.

The tensile test and Charpy impact test are made with respect to the resulting thick steel plates to examine mechanical properties, while the hardness of the steel plate at section is measured from an outer surface thereof at a pitch of 2 mm to examine a hardness distribution in a thickness direction for evaluating the scattering of strength in the thickness direction. Further, in order to evaluate the toughness of HAZ, the steel plate is subjected to a heat cycle of heating to 1350° C. and cooling from 800° C. to 500° C. for 300 seconds (corresponding to heat hysteresis of HAZ when the welding is carried out at a heat input of 500 kJ/cm), from which a specimen for Charpy impact test is taken out to measure a Charpy absorption energy at 0° C.

The measured results are shown in Table 2, from which it is apparent that the thick steel plates according to the invention has a tensile strength of not less than 400 MPa, and the scattering of hardness in the thickness direction for homogenizing the texture is very small as compared with that of the comparative example, and the difference of hardness between maximum value and minimum value is in 20 as Hv. Moreover, the volume ratio of bainite texture is measured by point counting process from an optical microphotograph of 400 magnification.

TABLE 1

| | Chemical composition (wt %) | | | | | | | | | | | | | | | | |
|---|---|---|---|---|---|---|---|---|---|---|---|---|---|---|---|---|---|
| Steel No. | C | Si | Mn | Nb | B | Al | Cu | Ti | V | Ni | Cr | Mo | W | Zr | REM | Ca | Remarks |
| 1 | 0.0006 | 0.05 | 1.50 | 0.022 | 0.0013 | 0.035 | — | — | — | — | — | — | — | — | — | — | Comparative Example |
| 2 | 0.001 | 0.02 | 1.55 | 0.024 | 0.0018 | 0.032 | — | — | — | — | — | — | — | — | — | — | Invention Example |
| 3 | 0.008 | 0.01 | 1.65 | 0.015 | 0.0017 | 0.030 | — | — | — | — | — | — | — | — | — | — | Invention Example |
| 4 | 0.015 | 0.03 | 1.60 | 0.021 | 0.0015 | 0.025 | — | — | — | — | — | — | — | — | — | — | Invention Example |
| 5 | 0.035 | 0.02 | 1.50 | 0.018 | 0.0015 | 0.035 | — | — | — | — | — | — | — | — | — | — | Comparative Example |
| 6 | 0.006 | 1.00 | 1.75 | 0.017 | 0.0015 | 0.030 | — | — | — | — | — | — | — | — | — | — | Comparative Example |
| 7 | 0.007 | 0.02 | 0.50 | 0.019 | 0.0009 | 0.030 | — | — | — | — | — | — | — | — | — | — | Comparative Example |
| 8 | 0.008 | 0.05 | 3.40 | 0.017 | 0.0015 | 0.025 | — | — | — | — | — | — | — | — | — | — | Comparative Example |
| 9 | 0.006 | 0.05 | 1.60 | 0.003 | 0.0015 | 0.200 | — | — | — | — | — | — | — | — | — | — | Comparative Example |
| 10 | 0.006 | 0.05 | 1.60 | 0.500 | 0.0015 | 0.032 | — | — | — | — | — | — | — | — | — | — | Comparative Example |
| 11 | 0.007 | 0.05 | 1.50 | 0.018 | — | 0.035 | — | — | — | — | — | — | — | — | — | — | Comparative Example |
| 12 | 0.009 | 0.05 | 1.50 | 0.018 | 0.0080 | 0.035 | — | — | — | — | — | — | — | — | — | — | Comparative Example |
| 13 | 0.011 | 0.05 | 1.80 | 0.015 | 0.0026 | 0.300 | — | — | — | — | — | — | — | — | — | — | Comparative Example |
| 14 | 0.007 | 0.03 | 1.75 | 0.017 | 0.0016 | 0.045 | — | — | — | 0.5 | — | — | — | — | — | — | Invention Example |
| 15 | 0.007 | 0.02 | 1.50 | 0.022 | 0.0014 | 0.035 | — | — | — | — | 0.3 | 0.32 | — | — | — | 0.005 | Invention Example |
| 16 | 0.006 | 0.04 | 1.50 | 0.025 | 0.0013 | 0.035 | — | — | — | 0.7 | — | — | — | 0.03 | — | — | Invention Example |
| 17 | 0.007 | 0.05 | 1.60 | 0.015 | 0.0015 | 0.035 | — | — | — | 0.5 | — | — | 0.2 | 0.03 | 0.006 | — | Invention Example |
| 18 | 0.006 | 0.03 | 1.60 | 0.030 | 0.0015 | 0.035 | — | — | — | — | — | 0.30 | — | — | — | — | Invention Example |
| 19 | 0.006 | 0.02 | 1.80 | 0.015 | 0.0015 | 0.035 | — | — | — | 0.6 | — | — | — | — | 0.006 | 0.003 | Invention Example |
| 20 | 0.003 | 0.02 | 1.55 | 0.035 | 0.0018 | 0.023 | — | 0.10 | — | — | — | — | — | — | — | — | Invention Example |
| 21 | 0.007 | 0.04 | 1.80 | 0.020 | 0.0013 | 0.024 | 1.80 | 0.01 | — | — | — | — | — | — | — | — | Invention Example |
| 22 | 0.005 | 0.01 | 1.80 | 0.025 | 0.0018 | 0.035 | — | — | 0.15 | — | — | — | — | — | — | — | Invention Example |
| 23 | 0.011 | 0.02 | 1.59 | 0.034 | 0.0012 | 0.032 | 1.10 | 0.01 | — | — | 0.3 | 0.10 | — | — | — | — | Invention Example |
| 24 | 0.008 | 0.02 | 1.85 | 0.033 | 0.0016 | 0.025 | — | — | 0.20 | 0.5 | — | — | — | — | 0.006 | — | Invention Example |
| 25 | 0.007 | 0.03 | 1.65 | 0.026 | 0.0018 | 0.033 | — | 0.15 | — | 0.3 | — | — | 0.2 | 0.03 | 0.003 | 0.006 | Invention Example |

TABLE 2

| Steel No. | Change of hardness (*) | Y.S (MPa) | T.S (MPa) | vTrs of base metal (° C.) | HAZ-vEo (J) | Volume ratio of bainite (%) | Remarks |
|---|---|---|---|---|---|---|---|
| 1 | 65 | 424 | 494 | −100 | 347 | 55 | Comparative Example |
| 2 | 11 | 446 | 497 | −96 | 330 | 100 | Invention Example |
| 3 | 6 | 464 | 510 | −95 | 320 | 100 | Invention Example |
| 4 | 17 | 407 | 507 | −98 | 335 | 100 | Invention Example |
| 5 | 21 | 471 | 520 | −95 | 293 | 100 | Comparative Example |
| 6 | 13 | 492 | 602 | −53 | 46 | 93 | Comparative Example |
| 7 | 35 | 328 | 407 | −86 | 330 | 34 | Comparative Example |
| 8 | 22 | 627 | 652 | −23 | 32 | 100 | Comparative Example |
| 9 | 46 | 370 | 430 | −74 | 330 | 7 | Comparative Example |

TABLE 2-continued

| Steel No. | Change of hardness (*) | Y.S (MPa) | T.S (MPa) | vTrs of base metal (° C.) | HAZ-vEo (J) | Volume ratio of bainite (%) | Remarks |
|---|---|---|---|---|---|---|---|
| 10 | 12 | 501 | 534 | −97 | 284 | 100 | Comparative Example |
| 11 | 32 | 330 | 414 | −110 | 301 | 12 | Comparative Example |
| 12 | 24 | 426 | 509 | −48 | 30 | 100 | Comparative Example |
| 13 | 14 | 465 | 528 | −20 | 22 | 100 | Comparative Example |
| 14 | 18 | 424 | 517 | −103 | 120 | 100 | Invention Example |
| 15 | 11 | 457 | 547 | −93 | 306 | 100 | Invention Example |
| 16 | 13 | 468 | 511 | −101 | 284 | 100 | Invention Example |
| 17 | 20 | 433 | 535 | −84 | 301 | 100 | Invention Example |
| 18 | 15 | 477 | 540 | −89 | 320 | 100 | Invention Example |
| 19 | 17 | 431 | 533 | −114 | 315 | 100 | Invention Example |
| 20 | 8 | 426 | 510 | −82 | 282 | 100 | Invention Example |
| 21 | 13 | 420 | 515 | −64 | 340 | 100 | Invention Example |
| 22 | 13 | 137 | 507 | −94 | 304 | 100 | Invention Example |
| 23 | 16 | 451 | 511 | −79 | 338 | 100 | Invention Example |
| 24 | 11 | 431 | 517 | −96 | 308 | 100 | Invention Example |
| 25 | 10 | 474 | 538 | −95 | 280 | 100 | Invention Example |

EXAMPLE 2

A slab of steel having an adjusted chemical composition as shown in Table 3 is subjected to a treatment under various conditions as shown in Table 4, whereby a thick steel plate having a thickness of 80 mm is produced.

As to the thus obtained thick steel plates, the tensile test and Charpy impact test are carried out in the same manner as in Example 1 to examine the mechanical properties, and also the scattering of strength in the thickness direction is examined.

The measured results are shown in Table 4, from which it is apparent that the thick steel plates according to the invention has a tensile strength of not less than 400 MPa, and the scattering of hardness in the thickness direction for homogenizing the texture is very small as compared with that of the comparative example. Furthermore, it is clear that the rise of strength is realized by adding precipitation strengthening elements and subjecting to precipitation strengthening treatment as compared with the invention examples containing no precipitation strengthening element as shown in Table 2.

TABLE 3

| Steel No. | Chemical composition | | | | | | | | | | | | | | | | Remarks |
|---|---|---|---|---|---|---|---|---|---|---|---|---|---|---|---|---|---|
| | C | Si | Mn | Cu | Nb | B | Al | Ti | Ni | Cr | Mo | V | Zr | W | Ca | REM | |
| 1 | 0.007 | 0.02 | 1.25 | — | 0.040 | 0.0018 | 0.033 | — | — | — | — | — | — | — | — | — | Invention steel |
| 2 | 0.007 | 0.04 | 1.60 | — | 0.050 | 0.0013 | 0.023 | 0.01 | — | — | — | — | — | — | — | — | Invention steel |
| 3 | 0.008 | 0.01 | 1.59 | 1.0 | 0.018 | 0.0018 | 0.035 | — | — | — | — | — | — | — | — | — | Invention steel |
| 4 | 0.009 | 0.03 | 1.78 | — | 0.015 | 0.0010 | 0.030 | — | — | — | — | 0.05 | — | — | — | — | Invention steel |
| 5 | 0.007 | 0.40 | 1.50 | 1.0 | 0.020 | 0.0013 | 0.033 | — | 0.5 | — | — | — | — | — | — | 0.006 | Invention steel |
| 6 | 0.005 | 0.02 | 1.50 | — | 0.030 | 0.0017 | 0.030 | 0.01 | — | — | — | 0.05 | — | — | — | — | Invention steel |
| 7 | 0.010 | 0.05 | 2.30 | 1.0 | 0.022 | 0.0015 | 0.028 | — | — | — | — | — | — | — | — | — | Invention steel |
| 8 | 0.008 | 0.01 | 1.80 | 1.0 | 0.020 | 0.0013 | 0.024 | — | — | — | — | — | — | — | — | — | Invention steel |
| 9 | 0.007 | 0.04 | 1.80 | 1.8 | 0.020 | 0.0013 | 0.024 | 0.01 | — | — | — | — | — | — | — | — | Invention steel |
| 10 | 0.007 | 0.01 | 1.50 | 1.2 | 0.018 | 0.0010 | 0.035 | 0.03 | — | — | — | — | — | — | — | — | Invention steel |
| 11 | 0.010 | 0.08 | 1.65 | 1.0 | 0.022 | 0.0014 | 0.040 | 0.50 | — | — | — | — | — | — | — | — | Comparative steel |
| 12 | 0.009 | 0.04 | 1.78 | 1.2 | 0.030 | 0.0013 | 0.024 | 0.01 | — | — | — | 0.02 | — | — | — | — | Invention steel |
| 13 | 0.007 | 0.04 | 1.65 | 0.7 | 0.010 | 0.0014 | 0.025 | 0.02 | 0.7 | — | — | — | — | — | — | — | Invention steel |
| 14 | 0.011 | 0.02 | 1.59 | 1.1 | 0.034 | 0.0012 | 0.032 | 0.01 | — | 0.30 | — | — | — | 0.10 | — | — | Invention steel |
| 15 | 0.010 | 0.01 | 1.52 | 1.0 | 0.025 | 0.0015 | 0.028 | — | — | — | — | — | 0.03 | — | 0.003 | 0.006 | Invention steel |
| 16 | 0.005 | 0.01 | 1.59 | 1.0 | 0.018 | 0.0018 | 0.035 | 0.01 | 0.5 | — | 0.1 | — | — | — | — | 0.006 | Invention steel |

TABLE 4(a)

| Steel No. | Heating temperature (° C.) | Rolling reduction at γ-region (%) | Finish rolling temperature (° C.) | (*) Cooling rate (° C.) | Cooling stop temperature (° C.) | Precipitation treating conditions |
|---|---|---|---|---|---|---|
| 1 | 1150 | 50 | 800 | Ac (2.0) | 550 | 550° C. × 40 min. |
| 2 | 1150 | 74 | 850 | Ac (7.0) | 550 | 550° C. × 40 min. |
| 3 | 1150 | 50 | 800 | Ac (1.0) | 570 | 550° C. × 40 min. |
| 4 | 1150 | 40 | 800 | Ac (2.0) | 630 | 630° C. × 40 min. |

TABLE 4(a)-continued

| Steel No. | Heating temperature (° C.) | Rolling reduction at γ-region (%) | Finish rolling temperature (° C.) | (*) Cooling rate (° C.) | Cooling stop temperature (° C.) | Precipitation treating conditions |
|---|---|---|---|---|---|---|
| 5 | 1150 | 40 | 800 | Air (0.2) | — | 550° C. × 40 min. reheating |
| 6 | 1000 | 40 | 800 | Ac (1.5) | 600 | 600° C. × 40 min. |
| 7 | 1150 | 40 | 850 | Ac (3.5) | 550 | 550° C. × 40 min. |
| 8 | 1150 | 50 | 850 | Ac (1.5) | 600 | 550° C. × 40 min. |
| 9 | 1150 | 74 | 850 | Ac (6.0) | 740 | cooling at 0.1° C./s for 40 min. |
| 10 | 1150 | 50 | 800 | Ac (2.5) | 600 | 550° C. × 40 min. |
| 11 | 1150 | 50 | 800 | Ac (3.0) | 600 | 550° C. × 50 min. |
| 12 | 1150 | 74 | 850 | Ac (6.5) | 550 | 550° C. × 30 min. |
| 13 | 1150 | 74 | 850 | Ac (6.0) | 650 | cooling at 0.05° C./s for 40 min. |
| 14 | 1150 | 50 | 800 | Air (0.2) | — | 550° C. × 50 min. |
| 15 | 1150 | 50 | 800 | Ac (1.0) | 580 | 550° C. × 50 min. reheating |
| 16 | 1150 | 50 | 800 | Ac (1.5) | 600 | 550° C. × 50 min. |

TABLE 4(b)

| Steel No. | (*) Cooling condition (° C./s) | (**) Change of hardness | Y.P (MPa) | T.S (MPa) | vTrs of base metal (° C.) | HAZ-vEo (J) | Volume ratio of bainite (%) | Remarks |
|---|---|---|---|---|---|---|---|---|
| 1 | Air (0.2) | 12 | 413 | 493 | −60 | 335 | 98 | Invention steel |
| 2 | Air (0.2) | 13 | 401 | 506 | −62 | 329 | 100 | Invention steel |
| 3 | Air (0.2) | 11 | 515 | 595 | −62 | 305 | 100 | Invention steel |
| 4 | Air (0.2) | 20 | 497 | 538 | −40 | 315 | 100 | Invention steel |
| 5 | Air (0.2) | 15 | 568 | 630 | −65 | 314 | 95 | Invention steel |
| 6 | Air (0.2) | 18 | 485 | 530 | −34 | 298 | 98 | rnvention steel |
| 7 | Air (0.2) | 15 | 606 | 651 | −47 | 321 | 100 | Invention steel |
| 8 | Air (0.2) | 12 | 541 | 611 | −34 | 328 | 100 | Invention steel |
| 9 | Air (0.2) | 12 | 525 | 629 | −15 | 330 | 100 | Invention steel |
| 10 | Air (0.2) | 11 | 585 | 619 | −66 | 321 | 100 | Invention steel |
| 11 | Air (0.2) | 18 | 598 | 635 | +28 | 5 | 100 | Comparative steel |
| 12 | Air (0.2) | 5 | 471 | 643 | −15 | 307 | 100 | Invention steel |
| 13 | Air (0.2) | 10 | 474 | 588 | −40 | 299 | 100 | Invention steel |
| 14 | Air (0.2) | 13 | 532 | 593 | −67 | 322 | 100 | Invention steel |
| 15 | Air (0.2) | 11 | 534 | 594 | −59 | 317 | 100 | Invention steel |
| 16 | Air (0.2) | 8 | 542 | 617 | −57 | 337 | 95 | Invention steel |

Figure 4A:
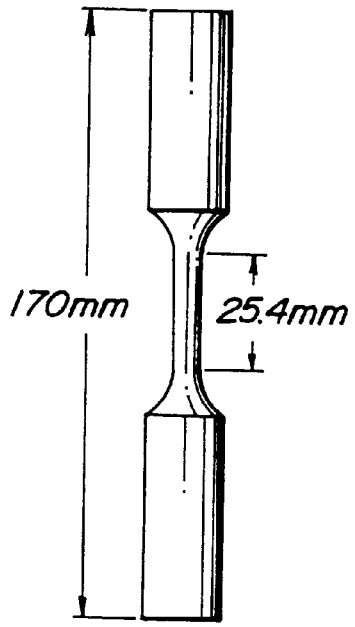
FIG. 4*a* and 4*b* is diagrammatic views of a test specimen used in a test for evaluating a resistance to stress corrosion cracking through sulfide and a testing apparatus therefor.
Figure 4B:
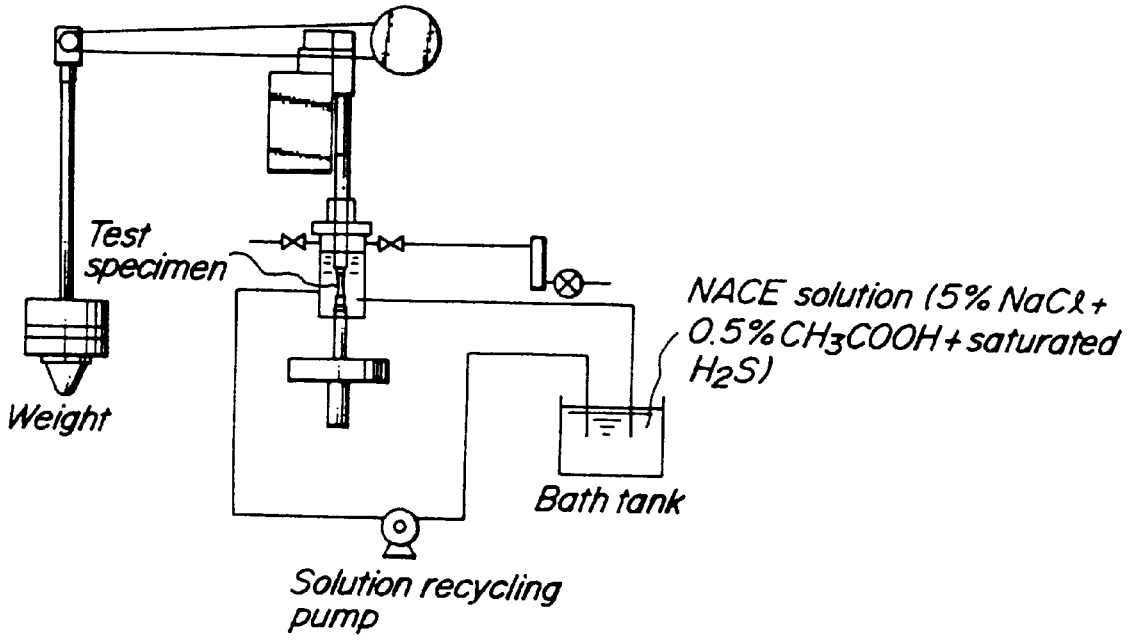
Figure 5:
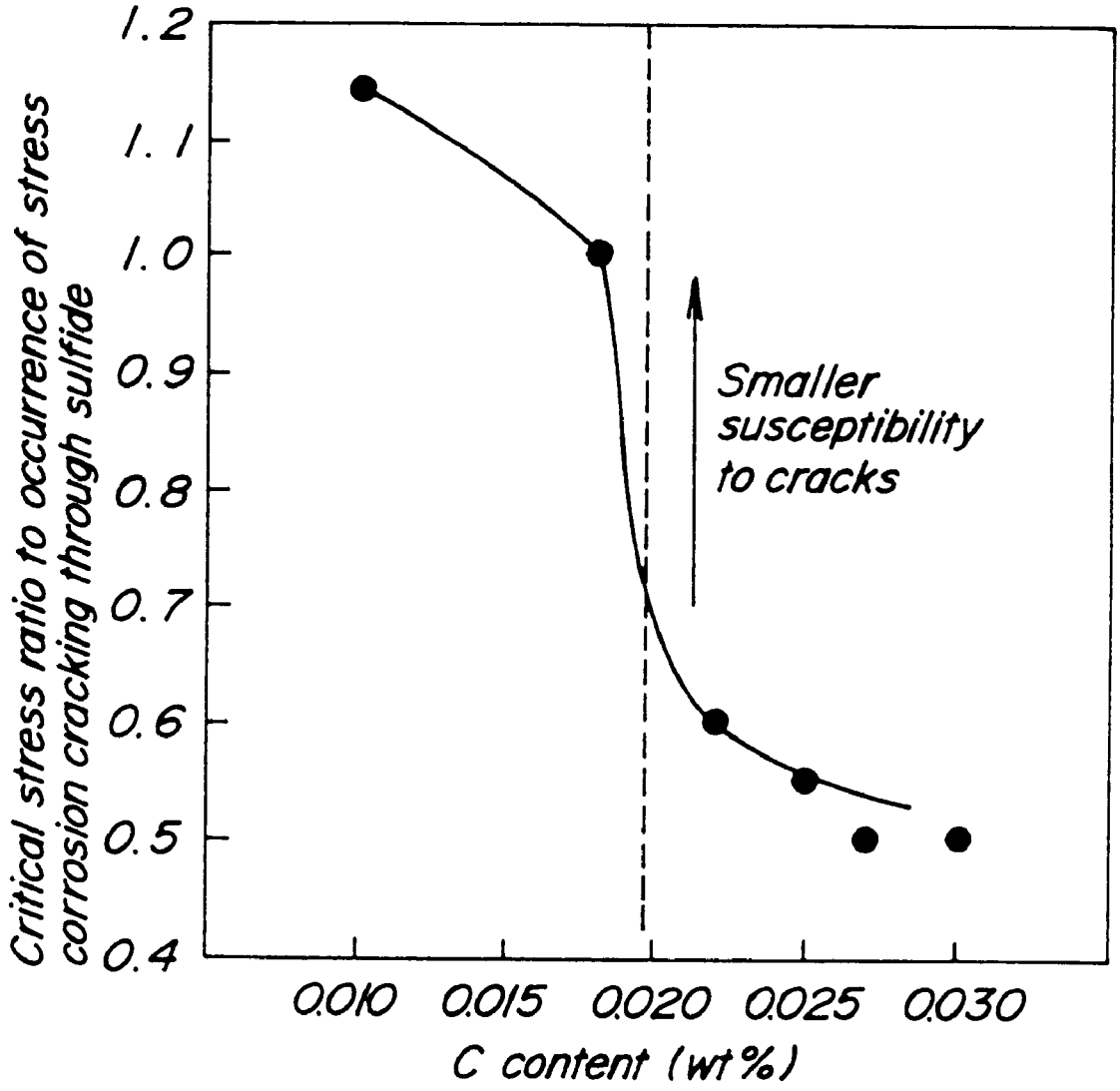
FIG. 5 is a graph showing a relation between C content and resistance to stress corrosion cracking through sulfide in a thick steel plate.

(*) Air . . . air cooling, Ac . . . acceleration cooling, value in parenthesis is cooling rate
() Difference of hardness between maximum value and minimum value As to thick steel plates having a chemical composition as shown in Table 5, the resistance to stress corrosion cracking through sulfide is evaluated after the slab is heated to 1150° C., rolled at a reduction of 50% up to 800° C., subjected to a reheating precipitation treatment at 550° C. for 40 minutes and then cooled in air. That is, a test specimen shown in FIG. 4**(*a*) is taken out from a central portion of the thick steel plate in the thickness direction, and stress is applied to this test specimen in an apparatus shown in FIG. 4(*b*), which is immersed in an NACE solution (5% NaCl+0.5% $CH_3COOH$+saturated $H_2S$) for 720 hours. The applied stress corresponds to 40–120% of 0.5% proof stress of the steel plate used in the tensile test. The resistance to stress corrosion cracking through sulfide is evaluated by a ratio of applied stress causing no breakage after the immersion of 720 hours to 0.5% proof stress. Moreover, the larger the numerical evaluation value, the better the resistance to stress corrosion cracking through sulfide. The evaluation results are also shown in Table 5, from which it is apparent that the steel sheets restricting C content to not more than 0.02 wt % are excellent in the resistance to stress corrosion cracking through sulfide.

TABLE 5

| | Chemical composition (wt %) | | | | | | | | | | | | | | |
|---|---|---|---|---|---|---|---|---|---|---|---|---|---|---|---|
| No. | C | Si | Mn | Al | Ti | B | Nb | Cu | V | Ni | Cr | Mo | W | REM | Ca |
| 1 | 0.010 | 0.04 | 1.79 | 0.025 | 0.020 | 0.0014 | 0.015 | 1.20 | 0.030 | 0.70 | — | — | — | — | 0.0029 |
| 2 | 0.018 | 0.04 | 1.80 | 0.023 | 0.020 | 0.0014 | 0.016 | 1.20 | 0.029 | 0.70 | — | — | — | — | 0.0030 |
| 3 | 0.022 | 0.05 | 1.80 | 0.024 | 0.019 | 0.0013 | 0.015 | 1.20 | 0.030 | 0.68 | — | — | — | — | 0.0028 |
| 4 | 0.025 | 0.06 | 1.78 | 0.024 | 0.020 | 0.0014 | 0.017 | 1.19 | 0.028 | 0.70 | — | — | — | — | 0.0031 |
| 5 | 0.027 | 0.05 | 1.81 | 0.023 | 0.020 | 0.0015 | 0.016 | 1.20 | 0.030 | 0.71 | — | — | — | — | 0.0029 |
| 6 | 0.030 | 0.05 | 1.80 | 0.023 | 0.018 | 0.0014 | 0.016 | 1.19 | 0.029 | 0.71 | — | — | — | — | 0.0030 |

INDUSTRIAL APPLICABILITY

In the thick steel plates according to the invention, the single phase of bainite texture is formed even at any cooling rates used at the cooling step in the production of industrial scale. Therefore, thick steel plates having a very less scattering of properties in the thickness direction, which will be anticipated to increase the demand in future, can stably be supplied in industrial scale. Moreover, the invention is advantageously adaptable to fields of section steel and rod steel.

We claim:

1. A bainite steel material having a less scattering of properties, wherein the steel material has a chemical composition comprising C: not less than 0.001 wt % but less than 0.018 wt %, Si: not more than 0.60 wt %, Mn: 1.00–3.00 wt %, Nb: 0.005–0.20 wt %, B: 0.0003–0.0050 wt % and Al: not more than 0.100 wt % and not less than 90% thereof is a bainite texture.

2. A bainite steel material having a less scattering of properties according to claim 1, wherein the steel material further contains Cu: 0.7–2.0 wt %.

3. A bainite steel material having a less scattering of properties according to claim 1, wherein the steel material further contains Ti: 0.005–0.20 wt %.

4. A bainite steel material having a less scattering of properties according to claim 1, wherein the steel material further contains V: 0.005–0.20 wt %.

5. A bainite steel material having a less scattering of properties according to claim 1, wherein the steel material further contains one or more of Ni: not more than 2.0 wt %, Cr: not more than 0.5 wt %, Mo: not more than 0.5 wt %, W: not more than 0.5 wt % and Zr: not more than 0.5 wt %.

6. A bainite steel material having a less scattering of properties according to claim 1, wherein the steel material further contains not more than 0.02 wt % of at least one of REM and Ca.

7. A method of producing a bainite steel material having a less scattering of properties in a hot rolling of a starting steel material having a chemical composition comprising C: not less than 0.001 wt % but less than 0.018 wt %, Si: not more than 0.60 wt %, Mn: 1.00–3.00 wt %, Nb: 0.005–0.20 wt %, B: 0.0003–0.0050 wt % and Al: not more than 0.100 wt %, wherein the starting steel material is heated to a temperature of $Ac_3$–1350° C. in the hot rolling of the starting steel material, and the rolling is terminated at an austenite unrecrystallization temperature region of not lower than 800° C. and then the cooling is conducted.

8. A method of producing a bainite steel material according to claim 7, wherein the starting steel material further contains Cu: 0.7–2.0 wt %.

9. A method of producing a bainite steel material according to claim 7, wherein the starting steel material further contains Ti: 0.005–0.20 wt %.

10. A method of producing a bainite steel material according to claim 7, wherein the starting steel material further contains V: 0.005–0.20 wt %.

11. A method of producing a bainite steel material according to claim 7, wherein the starting steel material further contains one or more of Ni: not more than 2.0 wt %, Cr: not more than 0.5 wt %, Mo: not more than 0.5 wt %, W: not more than 0.5 wt % and Zr: not more than 0.5 wt %.

12. A method of producing a bainite steel material according to claim 7, wherein the starting steel material further contains not more than 0.02 wt % of at least one of REM and Ca.

* * * * *